US005884978A

United States Patent [19]

Bell et al.

[11] Patent Number: 5,884,978

[45] Date of Patent: Mar. 23, 1999

[54] HAMMER TOOL FOR BOOM MOUNTABLE POWER HAMMER

[75] Inventors: Richard A. Bell, Renton; David J. Markham, Tumwater; William D. Blackburn, Federal Way, all of Wash.

[73] Assignee: Ramco Construction Tools Inc., Kent, Wash.

[21] Appl. No.: 810,827

[22] Filed: Mar. 6, 1997

[51] Int. Cl.[6] ..... E21B 10/36

[52] U.S. Cl. ..... 299/100; 175/414; 299/37.4

[58] Field of Search ..... 299/69, 100, 37.3, 299/37.4, 37.5; 404/133.05, 133.1, 133.2; 175/135, 414

[56] References Cited

U.S. PATENT DOCUMENTS 1,893,596 1/1933 Perkins ..... 404/133.1

FOREIGN PATENT DOCUMENTS 926614 5/1973 Canada ..... 299/69
271684 3/1914 Germany ..... 404/133.1
973687 11/1982 U.S.S.R. ..... 404/133.05
1813174 4/1993 U.S.S.R. ..... 175/135

*Primary Examiner*—David J. Bagnell
*Attorney, Agent, or Firm*—Kathleen T. Petrich

[57] ABSTRACT

An improved hammer tool (20) for a boom mountable power hammer (14) for use in demolishing a work surface (12) of concrete and the like. The hammer tool (20) includes an elongated cylindrical body (22) having a first end (24) and a second end (26). The first end, (24) has a shank (28) of a size and shape to be received into the commercial power hammer (14). A hammer head (30) includes a top (32) and a bottom (34). The top (32) connects the hammer head (30) to the second end (26) at a transition section (38). The bottom (34) includes a convex shaped radial striking face (40), which is a portion of a sphere having a center (54) within a portion of the body. In use, the shank (28) and a portion of the body (51) containing center (54) is received and supported within the power hammer (14). The hammer head (30) is raised and lowered to make striking contact with the work surface (12) in a number sufficient to demolish the work surface (12). Resulting stress from the impact, or striking contact, is concentrated at the center (54) within the power hammer supported portion of the hammer tool body (51) in order to reduce stress fracture failure of the hammer tool.

14 Claims, 5 Drawing Sheets

FIG. 3
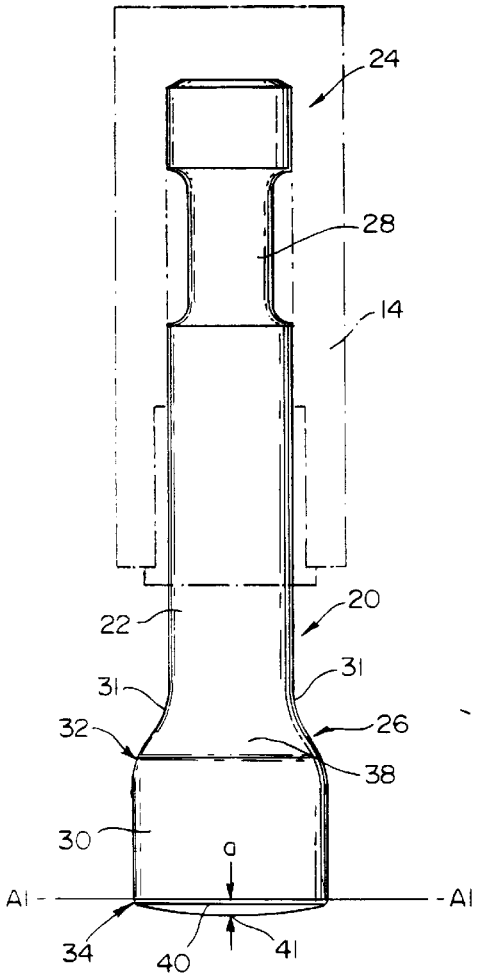
FIG. 13
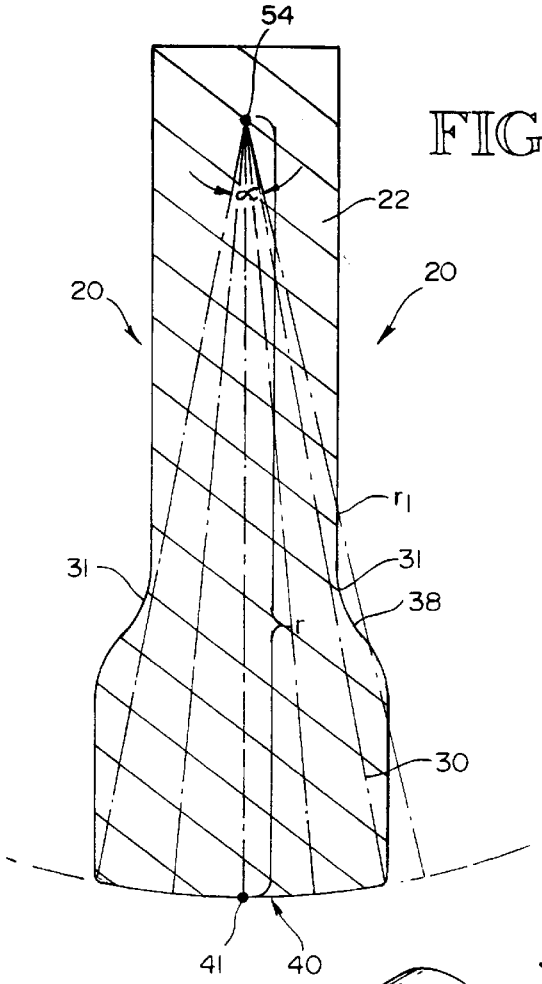
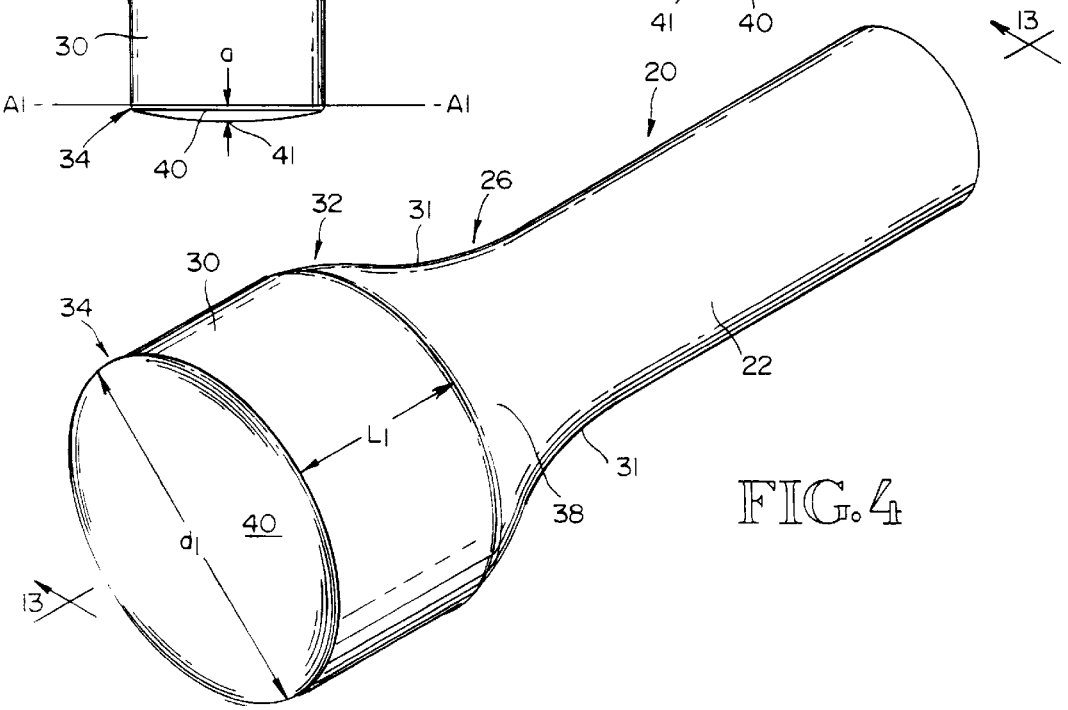
FIG. 4

HAMMER TOOL FOR BOOM MOUNTABLE POWER HAMMER

TECHNICAL FIELD

The present invention relates to hammer tools, or bits, for boom mountable power hammers used in demolition. More particularly, the invention relates to a hammer tool having a convex shaped radial striking face in order to concentrate resulting stress from use within a power hammer supported portion of the hammer tool.

BACKGROUND OF THE INVENTION

Tools, such as chisels and moil points, have long been used in demolition to break up concrete and the like. Hammer tools have been commonly used in conjunction with boom mountable power hammers for demolishing concrete because the hammer head has a larger striking face that can break up more concrete at each strike, or impact, than a traditional chisel or moil point. FIG. 1 shows the typical prior art hammer tool, or bit, 2 having an elongated body 4 with a shank 6 at one end and a hammer head 8 at the other end of the body 4. The hammer head 8 has a large, flat, circular striking face 10 in which to break up a work surface 12, such as concrete and the like.

In use, the shank 6 of hammer tool 2 is received into a power hammer 14, (shown in phantom). Much of the body 4, as well as the hammer head 8, extends externally and downwardly of power hammer 14. The power hammer 14 is raised and lowered over the work surface 12, in order to bring hammer head 8 into striking contact with work surface 12, typically, in a force range of up to 15,000 ft.-lbs class.

When hammer head 8 makes striking contact with the work surface, the hammer head is subjected to very high stress from the impact. The flat striking face of the hammer head directs all of the resulting stress upward at the time of impact. Stress lines are shown in dashes on FIG. 1, which are generally perpendicular to that of the striking face 10. The resulting stress is born by the hammer head 8, and is not concentrated within the power hammer supported portion of hammer tool 2. Hence, these type hammer tools can sustain hairline fractures, which can quickly lead to catastrophic failure of hammer head 8, thereby rendering hammer tool 2 useless.

These type of hammer tools are expensive, typically costing several hundred or even thousands of dollars. These type of hammer tools are heavy, as well, weighing anywhere from 100 to 1500 lbs. If catastrophic failure occurs, costly delays may ensue as replacement hammer tools may not be readily available, especially if the demolition site is remote. Additionally, injury to workers or property, could result as a consequence of catastrophic failure.

Moreover, although not generally intended, the hammer tool striking face may not always strike the work surface in a perpendicular (non offset) manner, such as shown in FIG. 2. This situation may occur because the work surface is not perfectly horizontal, or it may be attributed to operator error. Stress in this circumstance is concentrated at one end of the hammer head and adjacent portion of the body, shown at "16". Early catastrophic failure of the hammer tool is likely to occur at the unsupported area of the stress concentration.

DISCLOSURE OF THE INVENTION

The present invention relates to an improved hammer tool for a boom mountable power hammer for use in demolishing a work surface of concrete and the like. The hammer tool includes an elongated cylindrical body having a first end and a second end. The first end has a shank of a size and shape to be received and supported into the power hammer. A cylindrical hammer head having a top and a bottom is connected to the second end of the body at the hammer head's top. The bottom of the hammer head has a convex shaped radial striking face that is a portion of a sphere having a center within a portion of the body. In use, the shank and a portion of the body containing the center is received and supported within the power hammer. The remaining portion of the body and the hammer head extend externally and downwardly of the power hammer.

In preferred form, a cylindrical transition section connects the top of the hammer head to the body forming a sloping exterior surface from the body to the hammer head. The transition section slopes radially downwardly and outwardly from the body to the top of the hammer head. Each radius from the center to every point on the radial striking face is uninterrupted by the exterior surface.

In use, the shank and portion of the hammer tool body is received and supported within the power hammer such that the resulting stress during striking contact of the radial striking face with the work surface is concentrated at a point, which is the center. When a vertical plane extends perpendicularly through the substantially conical area to form the stress concentration point to the radial striking face, an angle is formed in the range of 20–30 degrees with a vertex of the angle being the center. In preferred form, that angle is 21 degrees.

It is an aspect of the present invention that the diameter of the radial striking face is not more than 2 times that of the diameter of the cylindrical body. In preferred form, the radial striking face is 1.6 times larger than the diameter of the cylindrical body. It is also an aspect of the invention that the radius from the stress concentration point to any point on the radial striking face is in the range of 20–30 inches. The length of the hammer head is preferably 0.8 times the diameter of the hammer head. Also, the remaining portion of the body that extends downwardly and externally from the power hammer has a length of approximately 5 inches.

These and other advantages, objects and features will become apparent from the following best mode description, the accompanying drawings, and the claims, which are all incorporated herein as part of the disclosure of the invention.

BRIEF DESCRIPTION OF THE DRAWINGS

Like reference numerals are used to designate like parts throughout the several views of the drawing, wherein:

FIG. 3 is a side view of the hammer tool of the present invention received into a power hammer, (shown in phantom) similar to that power hammer shown in FIGS. 1 and 2;

FIG. 4 is a pictorial view of the hammer tool of FIG. 3 shown less the shank;

FIG. 13 is a section view taken along lines 13—13 of FIG. 4, with resulting stress shown in dashed lines (the work surface is omitted) and depicting the radius curvature.

BEST MODE FOR CARRYING OUT THE INVENTION

Figure 1:
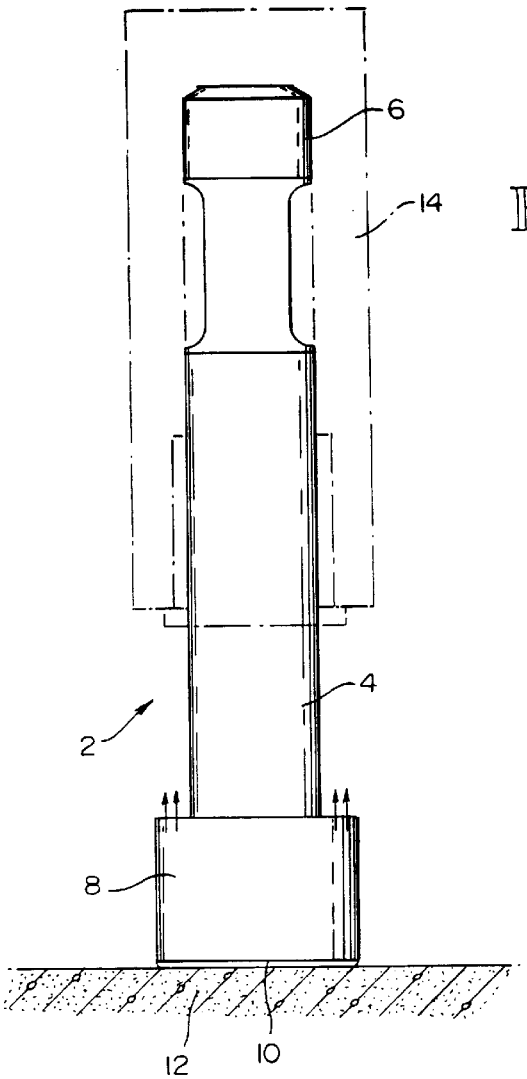
FIG. 1 is a side view of a prior art hammer tool that is received into a power hammer, shown in phantom, making striking contact with a work surface (shown in section), and showing resulting stress to the hammer tool in dashed lines.

The present invention is directed to an improved hammer tool, or bit, for a boom mountable power hammer for use in demolition. Referring to FIGS. 3–6, the hammer tool, or bit, 20 of the present invention is an improvement over that of the prior art hammer tool 2, shown in FIGS. 1 and 2. Hammer tool 20 includes an elongated cylindrical body 22 having a first end 24 and a second end 26. First end 24 includes a shank 28 of a size and shape to be received into a commercial power hammer 14 of the same type disclosed in FIG. 1. A hammer head 30 having a top 32 and a bottom 34 is adjacent and integral with second end 26 of body 22. Top 32 is connected to body 22 at transition section 38, which connects hammer head 30 to body 22. Transition section 38 slopes radially downwardly and outwardly from body 22 to top 32 of hammer head 30, forming a sloping exterior surface 31 from the body 22 to hammer head 30. The sloping shape of the transition section ensures that there are no sharp angular faces (such as shown in the prior art) where stress could concentrate during demolition impact.

A significant feature of the present invention is that bottom 34 includes a convex shaped radial striking face 40 that is a portion of a sphere (better shown in FIG. 13) having a center 54, that is received with a portion of the body 20. Radial striking face 40 is outwardly curved along the entire bottom 34 of hammer head 30. The benefits of the radial striking face 40 are discussed further in detail below.

Hammer head 30 is preferably cylindrical in shape, as the entire hammer tool is generally turned on a lathe. It is preferred to have the largest diameter hammer head possible in relation to the body in order to demolish the most concrete in a given time. To that end, the diameter of the hammer head $d_1$ is preferably 1.6 times the diameter of the cylindrical body $d_2$. Although it is preferred that the $d_1$ be 1.6 times that of $d_2$, the hammer tool of the present invention can incorporate a $d_1$ of up to 2 times that of $d_2$. The length of hammer head 30 is denoted as $L_1$. $L_1$ is determined by multiplying the diameter of the hammer head $d_1$ times 0.8. For example, a 20 inch diameter hammer head, would have a hammer head length of 16 inches. The distance "a" between the most convex point 41 on striking face 40 and horizontal plane A1—A1 is approximately 7% of the diameter of the hammer head $d_1$, as shown in FIG. 3. For example, an 11 inch hammer head diameter would have a convex distance "a" of approximately 0.77 inches.

Once the hammer tool has completed the machining process, the hammer tool is then subjected to heat treating in order to meet a breaking strength requirement of 200,000 psi.

The hammer tools of the present invention are classified by hammer head diameter: 8 inches and under (the smaller hammer tools) or above 8 inches (the larger hammer tools). The preferred material for the larger hammer tools is EN30b. The smaller hammer tools are preferably made from AISI 4340 alloy steel.

Figure 7:
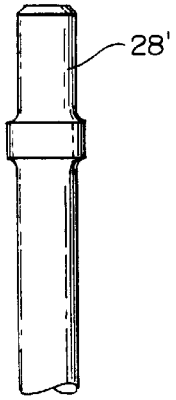
FIGS. 7–9 are side views of various embodiments of shanks.
Figure 8:
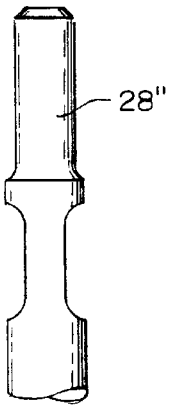
Figure 9:
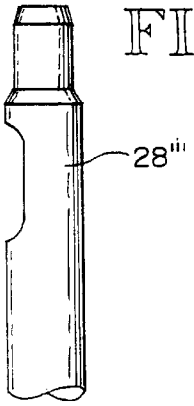
Figure 11:
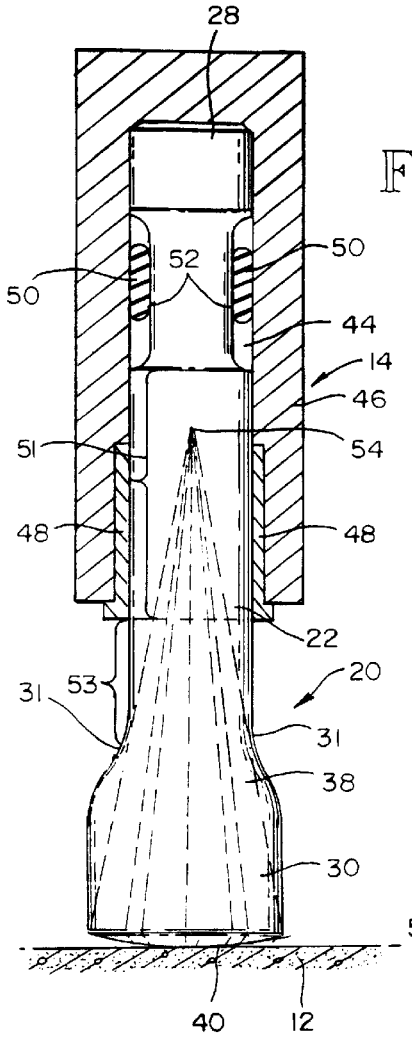
FIG. 11 is a view like FIG. 3, except that the power hammer is shown in section and the hammer tool is making striking contact with a generally horizontal work surface, and showing the resulting conical shaped stress in dashed lines concentrated within a power hammer supported portion of the hammer tool.
Figure 12:
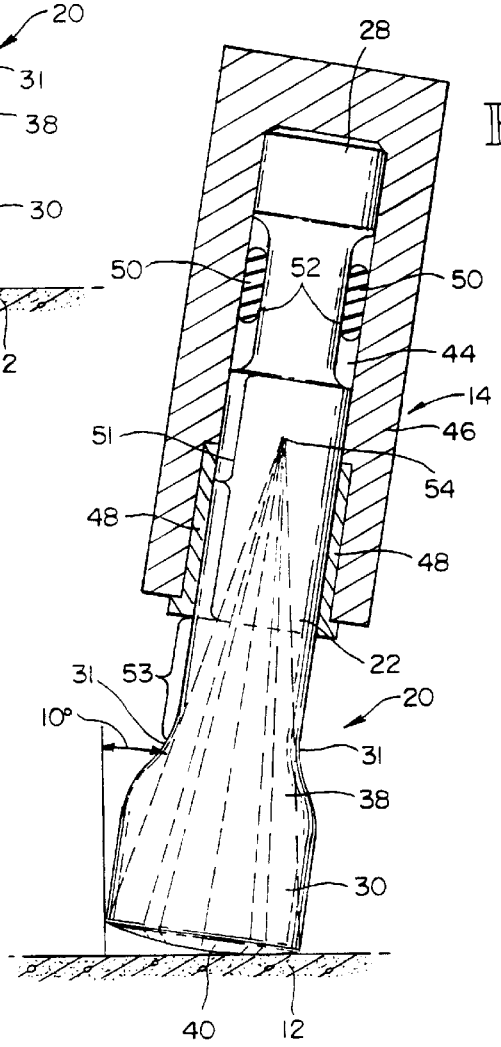
FIG. 12 is a view like that of FIG. 11, except that the hammer tool is offset 10 degrees from vertical when striking the work surface.

The shank's size and shape is dependent on the specific power hammer manufacture's specification. The hammer tool of the present invention may accommodate virtually any power hammer. Although power hammer 14 is normally hydraulic, power hammer 14 is not so limited, and may be pneumatic, or electric, as well. Typical of such hydraulic power hammers manufactures are Allied, a licensee of Krupp of Germany; NPK (or Nippon Pneumatics) of Japan; Kent of Japan; Tramac of France; a division of Ingersoll Rand Corp; and Rammer of Finland. The power hammer 14, as shown, is a Kent 50G model; therefore the shank as shown in FIGS. 3, 11–12 are of a size and shape to accommodate the Kent 50G. FIGS. 7–9 illustrate the variety of shank types, denoted as 28', 28", and 28'", respectively, for various power hammer types. FIGS. 7–9 are illustrative only and are not intended to be limiting in any way, as the shank design for the present invention may be of any size and shape dictated by the specific power hammer manufacturer.

Figure 2:
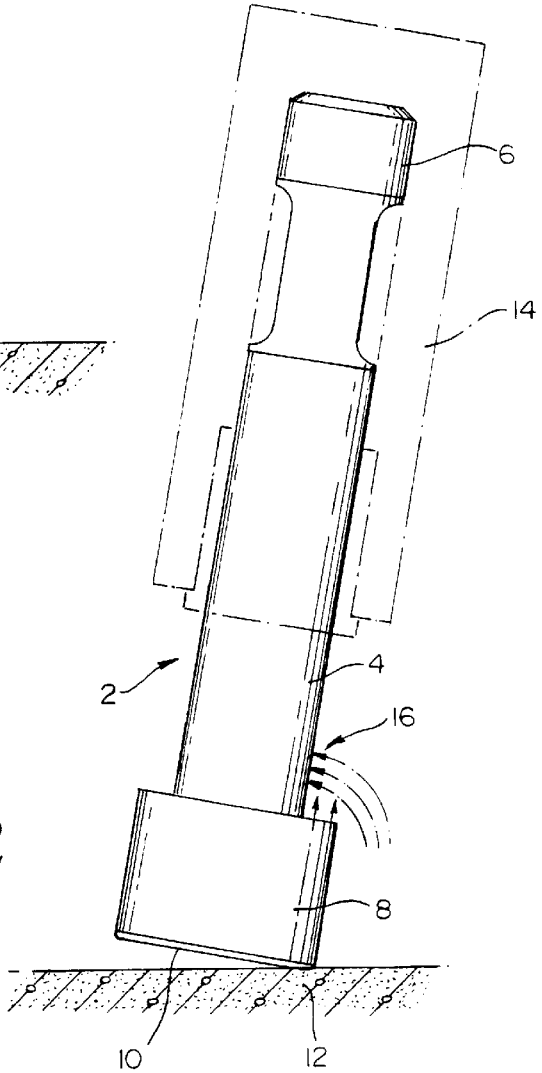
FIG. 2 PRIOR ART
FIG. 2 is a view of the prior art hammer tool like that of FIG. 1, except the hammer head is shown offset from vertical when striking the work surface.
Figure 5:
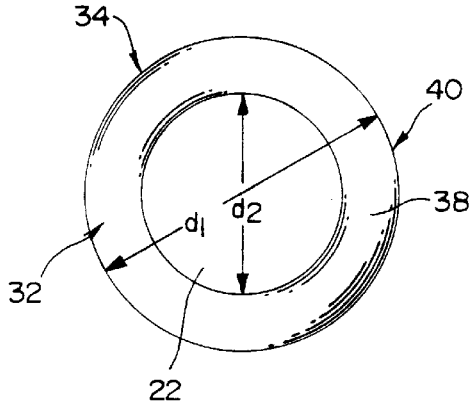
FIG. 5 is a top plan view of the hammer tool of FIG. 4.
Figure 6:
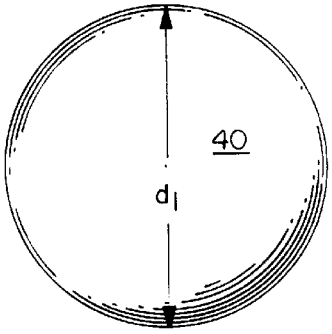
FIG. 6 is a bottom plan view of the hammer tool of FIG. 4.
Figure 10:
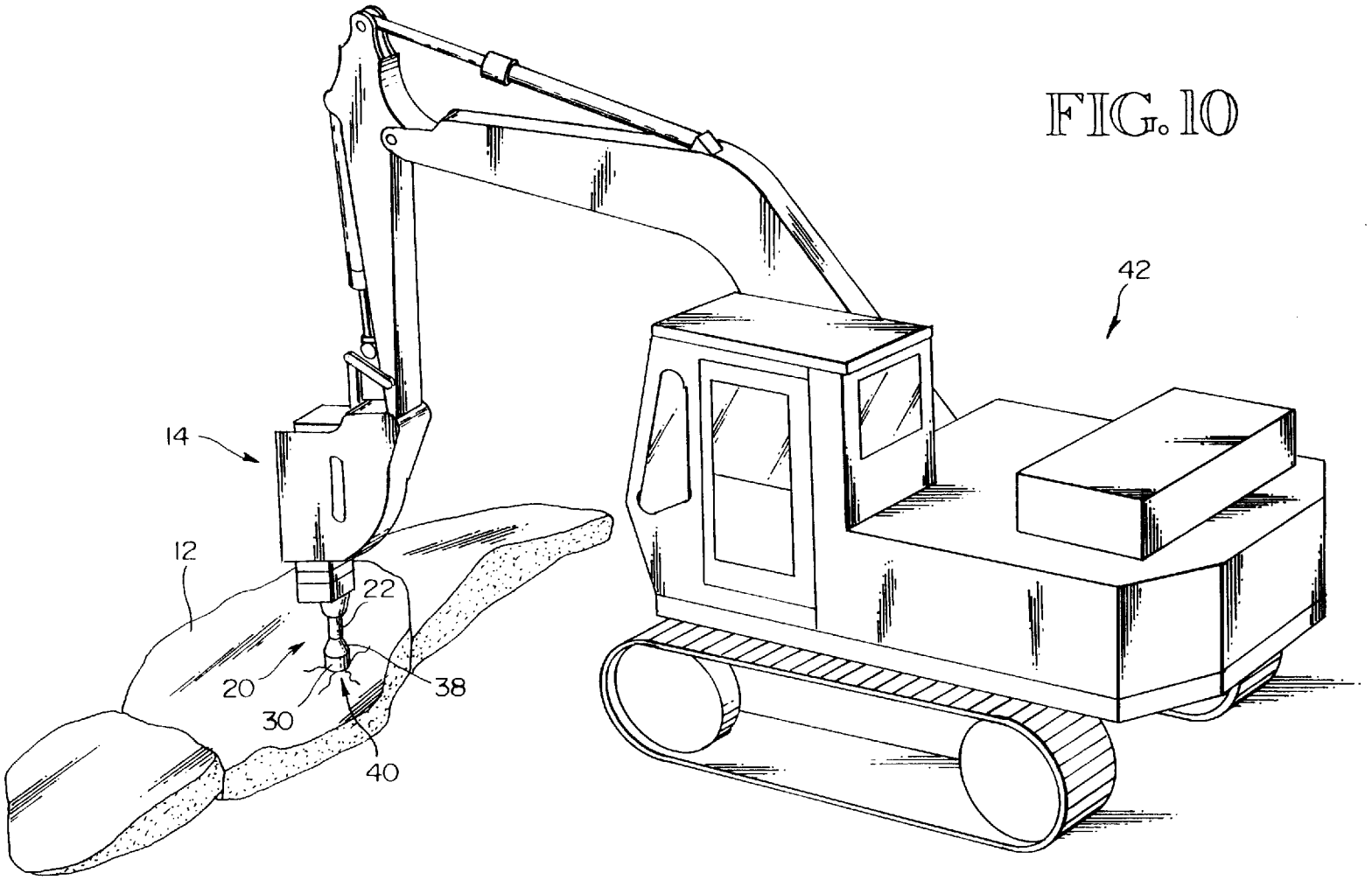
FIG. 10 is a pictorial view of the hammer tool of the present invention received and supported in the power hammer, which is mounted to an articulated boom construction vehicle, and showing the hammer tool making striking contact with a work surface that is to be demolished.

Referring to FIG. 10, in use, the hammer tool 20 is received into power hammer 14, which is mounted on an articulated boom construction vehicle 42. Hammer tool 20 is raised and lowered over a work surface 12, which is the same as shown in FIG. 1, such as concrete and the like. In use, hammer tool 20 makes striking contact, (or demolition impact), with work surface 12 in a number of contacts sufficient to demolish the work surface.

Referring to FIG. 11, hammer tool 20 is received into an opening 44 within power hammer 14. Shank 28 is sized and shaped to fit within opening 44, specific to its particular power hammer, as discussed above. Typical to most, if not all, power hammers, each power hammer includes an outer bushing 46, which receives and supports the shank 28 and a portion of body 22, and an inner bushing 48 that receives and supports a portion of body 22. The received and supported portions of the body are collectively denoted as 51. Also typical, the power hammer generally includes a detent 50, shown in the form of a release bar, that holds a notched portion 52 of shank 28 firmly within opening 44. The outer bushing 46, inner bushing 48, and detent 50, act in concert to securely receive and support hammer tool 20 and block it from any movement.

Once installed, a remaining body portion 53 extends externally and downwardly approximately 5 inches below the bottom of the inner bushing 48. The 5 inch dimension is generic to all size models of the hammer tool of the present invention. The transition section 38 and hammer head extends externally and downwardly of the power hammer below the remaining body portion 53. In this manner, the externally and downwardly portion of hammer tool 20 that is unsupported is less than that of the prior art, as shown in FIG. 1. The benefit of this decrease in unsupported hammer tool portion is discussed next.

It has been found that the convex shape of the radial striking face 40 in combination with relatively large supported area of the hammer tool body 22 concentrates resulting stress from demolition impact (striking contact with the work surface) within the received and supported portion of the hammer tool body 51. The resulting stress forms a substantially conical shape, beginning with the radial striking face 40 and ending at an apex 54 (the center of the spherical portion), which is the stress concentration point. Stress concentration point (center) 54 is well within the supported area of hammer tool body 51. Because the stress is concentrated within the supported area of the hammer tool body, stress fracture is prevented. Thus, catastrophic failure of the hammer tool is unlikely. Costly shutdowns due to premature failure of hammer tools can, thus, be avoided.

Referring to FIG. 12, another benefit of the present invention is that stress still concentrates within the supported area of the hammer body 51 even if the hammer head strikes the work surface at up to approximately 10 degree offset from vertical, either due to an non horizontal work surface or operator error. The prior art hammer tool required a high degree of care or work surface choice to avoid offset striking, as premature failure could generally be expected under such circumstances.

Referring to FIG. 13, which is created by taking a vertical plane 13—13 through the hammer tool less the shank to expose a "triangle-like" shaped cut from the sphere, the radius r from any point on the convex radial striking surface 40 to the center 54 (stress concentration point) is in the range of 20–30 inches. The angle $\alpha$ created by the entire radial striking face and ending with the center 54, which acts as a vertex, is 20–30 degrees. In preferred form, the angle is 21 degrees. A key feature of the present invention is that each radius r, as determined from center 54 to every point on the radial striking face 40, is within an uninterrupted by exterior surface 31. An example of an interrupted radius ($r_1$) is shown.

In addition to use as a demolition tool, hammer tool 20 may also be used in tamping, such a packing down a heavy material. Although the radial striking surface may leave a convex "footprint", this footprint may not be undesirable depending on the material to which the hammer head is applied or the circumstances surrounding the packing.

It is to be understood that many variations in size, shape, and construction can be made to the illustrated and above-described embodiment without departing from the spirit and scope of the present invention.

The illustrated embodiments are only examples of the present invention and, therefore, are non-limitive. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. An improved hammer tool for a boom mountable power hammer for use in demolishing a work surface of concrete and the like, said hammer tool comprising:

an elongated solid cylindrical body having a first end and a second end;

said first end having a shank of a size and a shape to be received and supported into the power hammer;

a solid cylindrical hammer head having a top and a bottom, wherein said top connects to and is integral with said second end of said body, thereby connecting the hammer head to the body; and said bottom having a convex shaped radial striking face that is a portion of a sphere having a center within the body;

wherein, in use, the shank and a portion of the body containing the center are received and supported within the power hammer, and the remaining portion of the body and the hammer head extend externally and downwardly of the power hammer.

2. The hammer tool according to claim 1 further comprising:

a cylindrical transition section connecting the top of the hammer head to the body, wherein the transition section slopes radially downwardly and outwardly from the body to the top of the hammer head forming a sloping exterior surface from the body to the hammer head, such that each radius from the center to every point on the radial striking face spherical portion is uninterrupted by the exterior surface.

3. The hammer tool according to claim 2, wherein the longitudinal length of the remaining portion of the body is approximately five inches.

4. The hammer tool according to claim 1, wherein, in use, the shank and the portion of the hammer tool are received and supported within the power hammer such that the resulting stress during striking contact of the radial striking face with the work surface is concentrated at the center, which is within the power hammer supported portion of the hammer tool body.

5. The hammer tool according to claim 4, wherein, in use, the resulting stress forms a cone-like spherical portion beginning from the initial contact at the radial striking face and ending with the center.

6. The hammer tool according to claim 4, wherein the hammer head may make striking contact with the work surface with an offset up to 10 degrees from vertical and the resulting stress from such contact is still concentrated within the power hammer supported portion of the hammer tool body.

7. The hammer tool according to claim 1, wherein the diameter of the radial striking face is not more than 2 times that of the diameter of the cylindrical body.

8. The hammer tool according to claim 7, wherein the diameter of the radial striking face is 1.6 times larger than the diameter of the cylindrical body.

9. The hammer tool according to claim 7 further comprising:

a cylindrical transition section connecting the top of the hammer head to the body, wherein the transition section slopes radially downwardly and outwardly from the body to the top of the hammer head forming a sloping exterior surface from the body to the hammer head, such that each radius from the center to every point on the radial striking face spherical portion is uninterrupted by the exterior surface.

10. The hammer tool according to claim 1, wherein the length of the hammer head is 0.8 times the diameter of the hammer head.

11. An improved hammer tool for a boom mountable power hammer for use in demolishing a work surface of concrete and the like, said hammer tool comprising:

an elongated solid cylindrical body having a first end and second end;

said first end having a shank of a size and shape to be received and supported into the power hammer;

a solid cylindrical hammer head having a top and a bottom, wherein said top connects said hammer head to said body at its second end; and said bottom having a convex shaped radial striking face that is a portion of a sphere having a center within the body;

wherein, in use, the shank and a portion of the body containing the center are received and supported within the power hammer, and the remaining portion of the body and the hammer head extend externally and downwardly of the power hammer, and wherein the shank and the portion of the hammer tool body are received and supported within the power hammer such that the resulting stress during striking contact of the radial striking face with the work surface is concentrated at the center, which is within the power hammer supported portion of the hammer tool body, and wherein the resulting stress forms a cone-like spherical portion beginning from the initial contact at the radial striking face and ending with the center, and wherein an angle in the range of 20 to 30 degrees is formed when the cone-like spherical portion is cut by a vertical plane extending perpendicularly through the center and the radial striking face with the vertex of the angle being the center.

12. The hammer tool according to claim 11, wherein the angle is 21 degrees.

13. The hammer tool according to claim 5 further comprising:

a cylindrical transition section connecting the top of the hammer head to the body, wherein the transition section slopes radially downwardly and outwardly from the body to the top of the hammer head forming a sloping exterior surface from the body to the hammer head, such that each radius from the center to every point on the radial striking face spherical portion is uninterrupted by the exterior surface.

14. An improved hammer tool for a boom mountable power hammer for use in demolishing a work surface of concrete and like, said hammer tool comprising:

an elongated solid cylindrical body having a first end and a second end;

said first end having a shank of a size and a shape to be received and supported into the power hammer;

a solid cylindrical hammer head having a top and a bottom, wherein said top connects said hammer head to said body at its second end; and said bottom having a convex shaped radial striking face that is a portion of a sphere having a center within the body;

wherein, in use, the shank and a portion of the body containing the center are received and supported within the power hammer, and remaining portion of the body and the hammer head extend externally and downwardly of the power hammer, and wherein each radius from the center to any radial striking face spherical portion is in the range of 20 to 30 inches.

* * * * *

UNITED STATES PATENT AND TRADEMARK OFFICE

CERTIFICATE OF CORRECTION

PATENT NO. : 5,884,978

DATED : March 23, 1999

INVENTOR(S) : Richard A. Bell

It is certified that error appears in the above-identified patent and that said Letters Patent is hereby corrected as shown below:

In the Claims:

Claim 13: change "according to claim 5" to -- according to claim 11--.

On the Title page:

Assignee: Change from "Ramco Construction Tools Inc." to -- Ramco Construction Tools Inc. dba Xygon/Ramco Construction Tools --.

Signed and Sealed this

Tenth Day of August, 1999

*Attest:*

*Attesting Officer*

Q. TODD DICKINSON

*Acting Commissioner of Patents and Trademarks*